US007908876B2

(12) United States Patent
Shin et al.

(10) Patent No.: US 7,908,876 B2
(45) Date of Patent: Mar. 22, 2011

(54) REFRIGERATOR AND METHOD TO CONTROL THE SAME

(75) Inventors: Young Shik Shin, Seongnam-si (KR); Vladimir Urazaev, Suwon-si (KR); Jin Ha Jeong, Yongin-si (KR); Jung Soo Lim, Suwon-si (KR); Bong Su Son, Cheonan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 469 days.

(21) Appl. No.: 12/073,714

(22) Filed: Mar. 7, 2008

(65) Prior Publication Data

US 2008/0245081 A1 Oct. 9, 2008

(30) Foreign Application Priority Data

Apr. 6, 2007 (KR) ..... 10-2007-0034406

(51) Int. Cl.
*F25D 21/00* (2006.01)

(52) U.S. Cl. ..... 62/150; 62/62; 62/126

(58) Field of Classification Search ..... 62/62, 126, 62/150, 127, 129; 236/91 C
See application file for complete search history.

(56) References Cited

U.S. PATENT DOCUMENTS

2003/0029178 A1* 2/2003 Zentner et al. ..... 62/186

FOREIGN PATENT DOCUMENTS

JP 64-006684 1/1989
JP 06281315 A * 10/1994
JP 2003-214753 7/2003

OTHER PUBLICATIONS

Shibkov A.A. et al. "Intrinsic Electromagnetic Rediation of Growing Ice" *Nature* No. 9, 2000.
Russian Office Action for corresponding Russian Patent Application No. 2008109762/12(010555) date Apr. 13, 2009 (3 pgs).

* cited by examiner

*Primary Examiner* — Marc E Norman
(74) *Attorney, Agent, or Firm* — Staas & Halsey LLP

(57) ABSTRACT

A refrigerator and a method to control the same are provided. The refrigerator includes a body having a supercooling compartment, a cooling unit to provide cool air to the supercooling compartment, an electromagnetic radiation sensor to detect electromagnetic radiation emitted when a food placed in the supercooling compartment begins to freeze, an energy supply to apply energy to the food placed in the supercooling compartment to prevent freezing of the food, and a controller to receive a detection signal from the electromagnetic radiation and then to activate the energy supply. Electromagnetic radiation emitted from each beverage in a supercooled state when the beverage begins to freeze is detected and energy is applied to the beverage according to the detection.

16 Claims, 7 Drawing Sheets

REFRIGERATOR AND METHOD TO CONTROL THE SAME

CROSS-REFERENCE TO RELATED APPLICATIONS

This application claims the benefit of Korean Patent Application No. 10-2007-0034406, filed on Apr. 6, 2007 in the Korean Intellectual Property Office, the disclosure of which is incorporated herein by reference.

BACKGROUND

1. Field

The present invention relates to a refrigerator, and more particularly, to a refrigerator which can stably keep beverages in a supercooled state and a method to control the same.

2. Description of the Related Art

A refrigerator is generally a device that supplies cool air generated by a cooling unit to a storage compartment to maintain the freshness of various foods for a long time. If the inner temperature of the storage compartment of the refrigerator is controlled appropriately, it is possible to keep beverages in a supercooled state. By keeping beverages in the supercooled state, users can obtain beverages that are neither completely frozen nor completely melted, referred to as "slush".

When the temperature of a beverage is reduced below the freezing point at 1 atmosphere, its phase generally changes from liquid to solid but, in some cases, it may be in a supercooled state without being changed to solid. The state of liquid in a supercooled state without freezing below the freezing point is thermodynamically referred to as a metastable state. In the metastable state, the supercooled liquid is neither completely unstable nor completely stable so that it instantly undergoes a phase change to solid upon receiving disturbance, such as impact or vibration from ambient environments. Thus, the user can obtain slush from a beverage by cooling the beverage below the freezing point in a refrigerator without allowing any disturbance to be applied, and then removing the beverage from the refrigerator and applying disturbance at a desired time.

To keep a beverage in a refrigerator in a supercooled state, it is necessary to cool the beverage below the freezing point. The supercooled level of the beverage increases as the inner temperature of the refrigerator decreases. However, if the inner temperature is too low, the supercooled state is broken to allow the beverage to freeze, thereby failing to obtain slush. The limit of the supercool temperature of commercial beverages generally ranges from about −8° C. to about −12° C., although this value varies slightly depending on the type of beverage. Thus, it is possible to keep beverages in a supercooled state by adjusting the refrigerator temperature in a range of temperatures slightly higher than the supercool temperature limit.

An example of a cooling device which can supercool beverages is described in Japanese Patent Application Publication No. 2003-214753 (entitled "COOLING DEVICE TO SUPERCOOL BEVERAGE" and published on Jun. 30, 2003). The cooling device of this publication supplies appropriate cool air to a storage compartment, in which beverages are stored, to keep the temperature of the storage compartment below the freezing point.

However, the conventional cooling device collectively adjusts the inner temperature of the refrigerator regardless of the types of beverages so that beverages with a relatively high freezing point may freeze while the supercooled level of beverages with a relatively low freezing point may be reduced.

Further, the probability that the beverages will freeze near the lowest temperature point is increased if the adjusted inner temperature of the refrigerator greatly varies. Thus, the inner temperature of the refrigerator must be adjusted with a variation less than a specific temperature level (for example, ±0.5° C.). However, it is very difficult to satisfy this requirement through the method of supplying cool air using the conventional cooling device.

SUMMARY

Therefore, it is an aspect of the present invention to provide a refrigerator and a method to control the same, which can stably keep beverages in the refrigerator in a supercooled state.

Additional aspects and/or advantages of the invention will be set forth in part in the description which follows and, in part, will be apparent from the description, or may be learned by practice of the invention.

The foregoing and/or other aspects of the present invention may be achieved by providing a refrigerator including a body defining a supercooling compartment; a cooling unit to provide cool air to the supercooling compartment; an electromagnetic radiation sensor to detect electromagnetic radiation emitted when a food placed in the supercooling compartment begins to freeze; an energy supply to apply energy to the food placed in the supercooling compartment to prevent freezing of the food; and a controller to receive a detection signal from the electromagnetic radiation sensor and then to activate the energy supply.

A receiving portion where the food is to be placed may be provided in the supercooling compartment and the electromagnetic radiation sensor may be provided near the receiving portion.

A plurality of receiving portions may be provided and a plurality of electromagnetic radiation sensors corresponding respectively to the plurality of receiving portions may be provided.

A receiving portion where the food is to be placed may be provided in the supercooling compartment and the energy supply may be provided near the receiving portion.

A plurality of receiving portions may be provided and a plurality of energy supplies corresponding respectively to the plurality of receiving portions may be provided.

The controller may activate the energy supply when the electromagnetic radiation sensor detects electromagnetic radiation emitted when an ice nucleus forms in the food.

The controller may activate the energy supply when the electromagnetic radiation sensor detects electromagnetic radiation emitted when an ice nucleus grows in the food.

The refrigerator may further include a signal amplifier to amplify a detection signal generated by the electromagnetic radiation sensor.

The energy supply may be an electric heater capable of heating the food.

The foregoing and/or other aspects of the present invention may also be achieved by providing a method to control a refrigerator, the method including reducing a temperature of a supercooling compartment in which food is placed below a freezing temperature; detecting electromagnetic radiation emitted when the food placed in the supercooling compartment begins to freeze; and applying energy to the food to prevent freezing of the food when the food emits electromagnetic radiation.

When a plurality of foods are placed in the supercooling compartment, electromagnetic radiation of each of the foods may be individually detected and energy may be individually applied to each of the foods.

The energy may be applied to the food upon detection of electromagnetic radiation emitted when an ice nucleus forms in the food.

The energy may be applied to the food upon detection of electromagnetic radiation emitted when an ice nucleus grows in the food.

The method may further include detecting a change in electromagnetic radiation when an ice nucleus is removed from the food while the energy is applied to the food and stopping the application of energy to the food.

Applying the energy to the food may include applying the energy to the food for a specific time.

The energy applied to the food may be thermal energy.

The method may further include storing information regarding electromagnetic radiation emitted when the food begins to freeze in a memory.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE EMBODIMENTS

Figure 1:
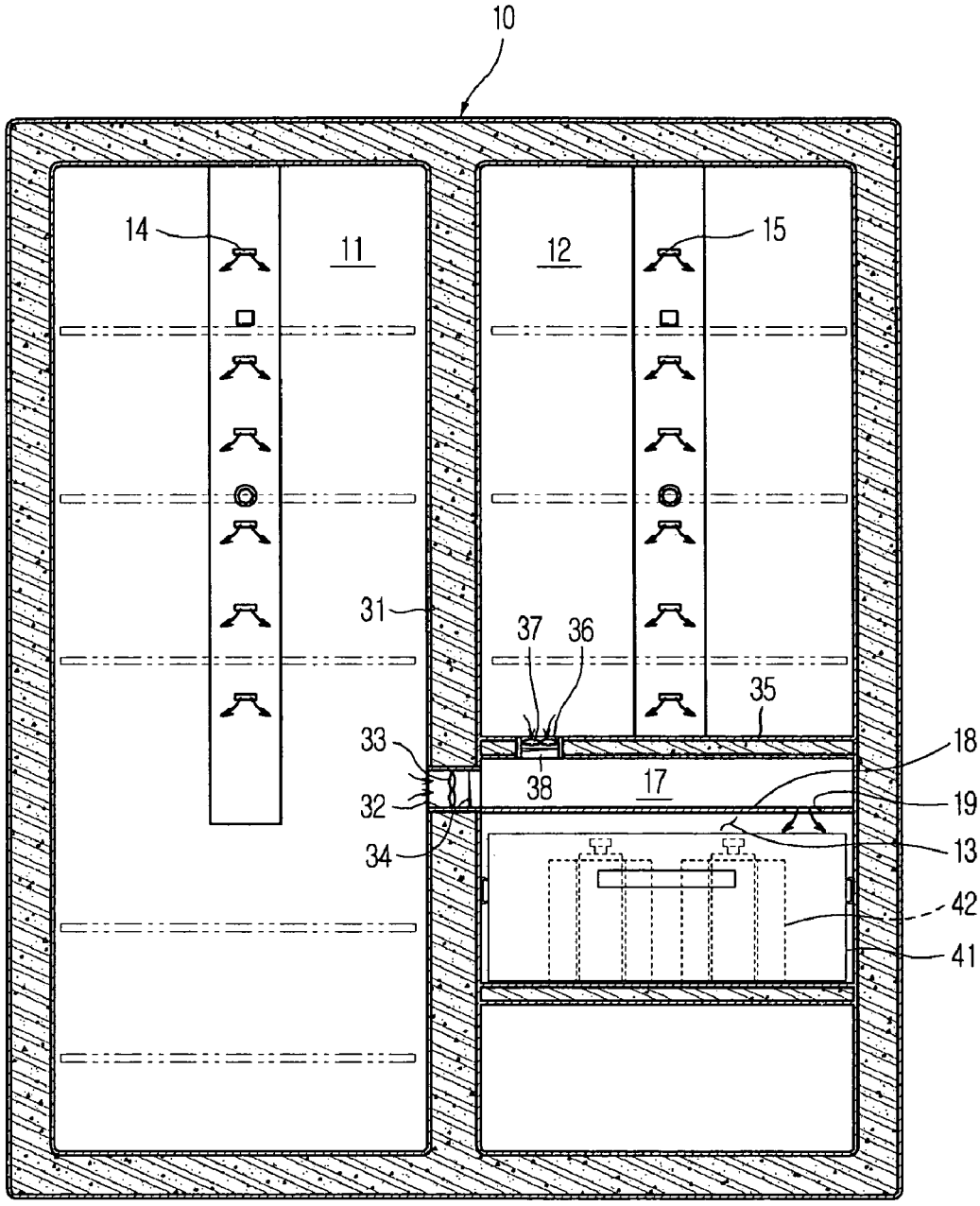
FIG. 1 is a front cross-sectional view schematically showing a refrigerator according to an embodiment of the present invention.

Reference will now be made in detail to the embodiments of a refrigerator and a method to control the same according to the present invention, examples of which are illustrated in the accompanying drawings, wherein like reference numerals refer to the like elements throughout. The embodiments are described below to explain the present invention by referring to the figures.

Figure 2:
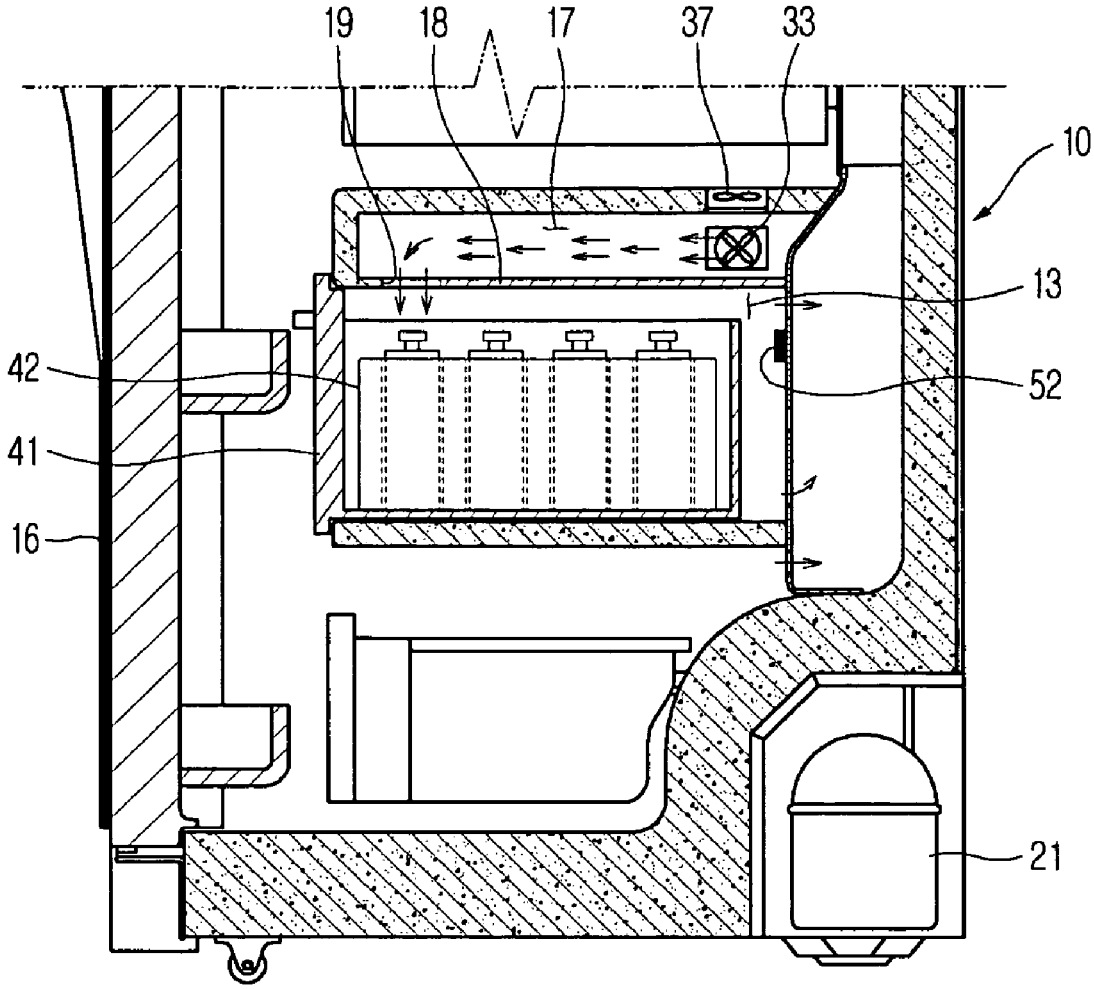
FIG. 2 is a side cross-sectional view schematically showing the refrigerator according to the embodiment of the present invention.
Figure 3:
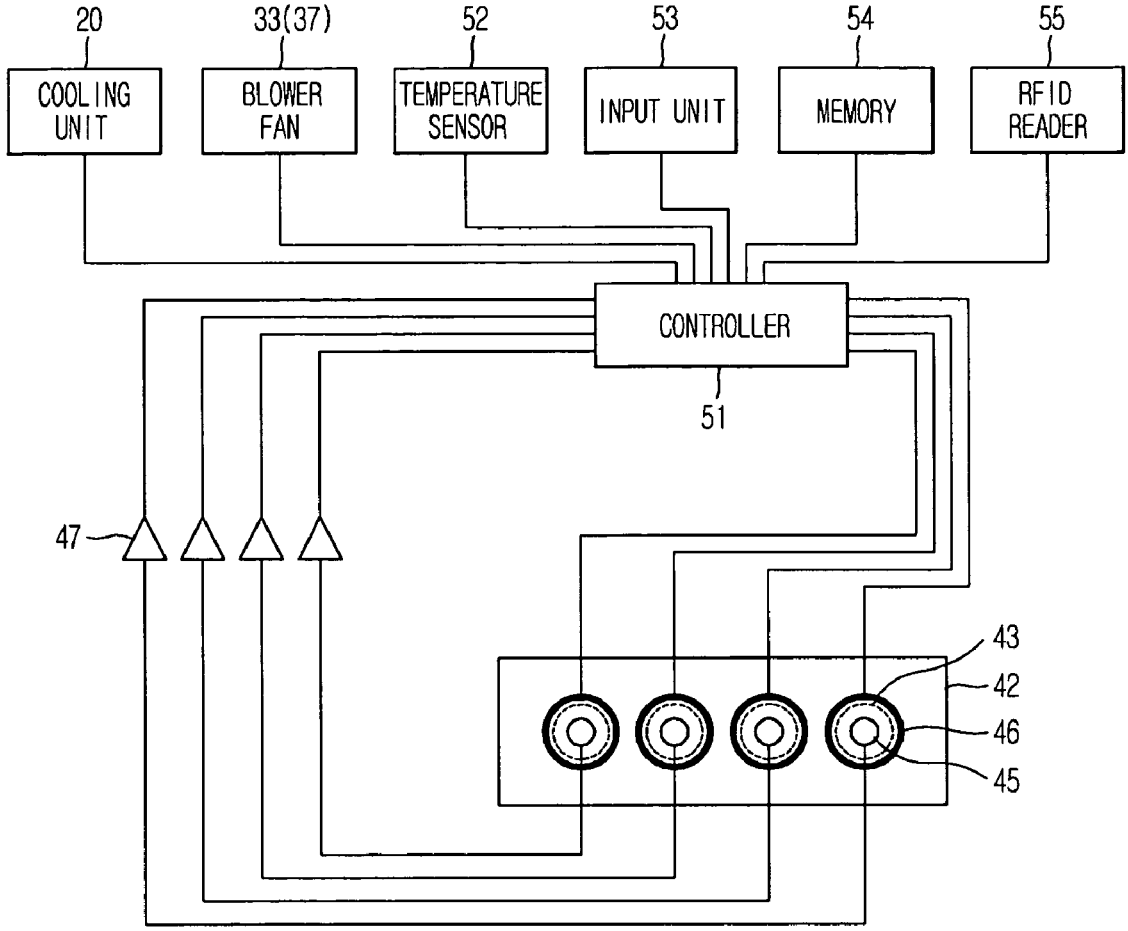
FIG. 3 is a block diagram showing main components of the refrigerator according to the embodiment of the present invention.

As shown in FIGS. 1 to 3, a refrigerator according to an embodiment of the present invention includes a body 10 having freezing, cooling, and supercooling compartments 11, 12, and 13, a cooling unit 20 to provide cool air to the freezing, cooling and supercooling compartments 11, 12, and 13, a plurality of receptacles 42 provided in the supercooling compartment 13, a plurality of electromagnetic radiation sensors 45 to detect electromagnetic radiation emitted from beverages contained in each of the receptacles 42, a plurality of electric heaters 46 to provide thermal energy to beverages contained in each of the receptacles 42 to prevent freezing of the beverages, and a controller 51 to control the overall operation of the refrigerator.

The interior of the body 10 is divided into the freezing compartment 11 and the cooling compartment 12 by a central dividing wall 31. A door 16 is mounted on the body 10 to open and close the freezing compartment 11 and the cooling compartment 12. Cool air generated by the cooling unit 20 is provided to the freezing compartment 11 and the cooling compartment 12 through a plurality of cool air inlets 14 and 15 connected to the interior of the body 10. This allows the freezing compartment 11 to be maintained at a freezing temperature (for example, in a range of −18° C. to −21° C.) which can sufficiently freeze food and allows the cooling compartment 12 to be maintained at a cooling temperature (for example, in a range of 3° C. to 5° C.) which can cool food. As with general cooling units, the cooling unit 20 includes a compressor 21 to compress refrigerant, a condenser (not shown) to condense refrigerant, a decompressor (not shown) to decompress refrigerant, an evaporator (not shown) to evaporate refrigerant, and a blower (not shown) to blow cool air generated by the evaporator into the cool air inlets 14 and 15.

The supercooling compartment 13 is provided under the cooling compartment 12 and is separated from the cooling compartment 12 by a dividing wall 35. A mixing compartment 17 in which cool air of the freezing compartment 11 and cool air of the cooling compartment 12 are mixed is provided above the supercooling compartment 13. The mixing compartment 17 and the supercooling compartment 13 are separated from each other by a separation plate 18. The central dividing wall 31 has an inlet 32 through which cool air of the freezing compartment 11 can be blown into the mixing compartment 17 and the dividing wall 35 above the mixing compartment 17 has an inlet 36 through which cool air of the cooling compartment 12 can be blown into the mixing compartment 17. Blower fans 33 and 37 for smooth blowing of cool air and flaps 34 and 38, which are opened or closed depending on activation of the blower fans 33 and 37, are provided in the inlets 32 and 36, respectively. When the blower fans 33 and 37 are activated, the flaps 34 and 38 are opened so that cool air of the freezing compartment 11 and cool air of the cooling compartment 12 are blown into the mixing compartment 17.

In the mixing compartment 17, cool air of the freezing compartment 11 and cool air of the cooling compartment 12 are mixed to generate cool air at a supercooling temperature (for example, in a range of −8° C. to −12° C.) which can supercool beverages. The cool air at the supercooling temperature is introduced into the supercooling compartment 13 through a cool air supply hole 19 formed in the separation plate 18. The temperature of cool air generated in the mixing compartment 17 is controlled by the amounts of cool air blown therein by the blower fans 33 and 37. The controller 51 controls the operations of the blower fans 33 and 37 based on a detection signal received from a temperature sensor 52 provided in the supercooling compartment 13. The temperature of the supercooling compartment 13 is maintained to be equal to the temperature of the cool air generated in the mixing compartment 17.

A tray 41 is slidably mounted in the supercooling compartment 13 and a plurality of receptacles 42 to contain beverages are provided in the tray 41. Since each of the receptacles 42 must be electrically connected to the controller 51, it is desirable that the tray 41 not be allowed to be completely separated from the body 10, while still being movable, and each receptacle 42 can be fixed to the tray 41.

Figure 4:
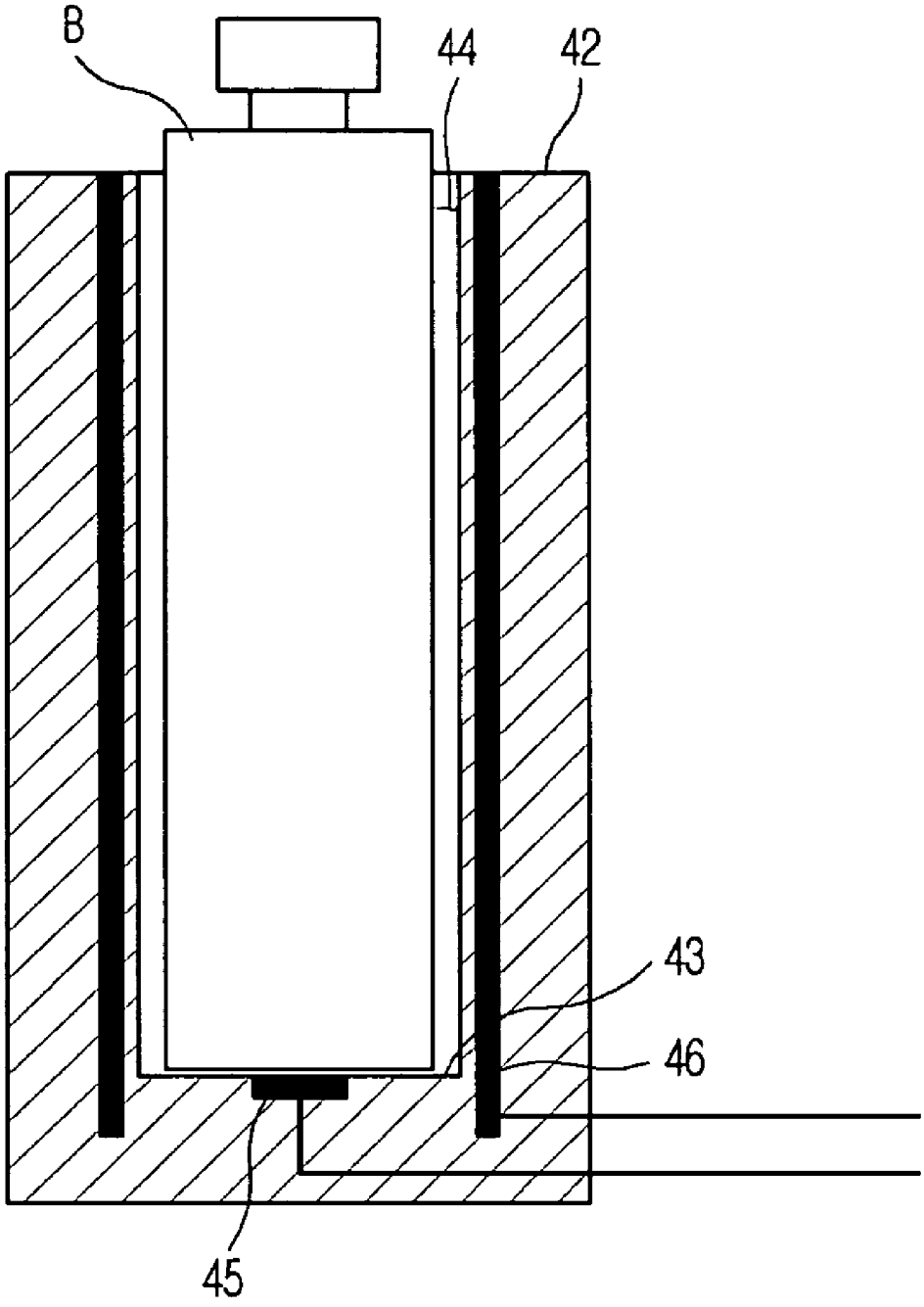
FIG. 4 is a front cross-sectional view showing a receptacle in the refrigerator according to the embodiment of the present invention.

As shown in FIGS. 3 and 4, each of the receptacles 42 has a plurality of receiving portions 43 and a plurality of receiving rooms 44 where beverages can be placed. Each of the receiving portions 43 and the receiving rooms 44 is designed to have a bottom area and a circumference appropriate to receive various sizes of commercial beverage containers. An electromagnetic radiation sensor 45 is provided under each receiving portion 43 and an electric heater 46 is provided around each receiving room 44 as an energy supply to apply energy to a beverage in the receiving room 44.

Each electromagnetic radiation sensor 45 and each electric heater 46 are electrically connected to the controller 51. The controller 51 receives a detection signal generated by each electromagnetic radiation sensor 45 and individually activates each electric heater 46 according to the detection signal. When the controller 51 activates the electric heater 46, the electric heater 46 provides thermal energy to a beverage contained in the receiving room 44. The electric heater 46 may be any type of heating element, which can generate heat through electrical control, such as a heating wire or a heat lamp. The electric heater 46 may be replaced with another energy supply which can apply a different type of energy than thermal energy to a beverage to prevent freezing of the beverage.

The electromagnetic radiation sensor 45 is a sensor that detects electromagnetic radiation emitted by a beverage and can be implemented in various forms using known electromagnetic radiation detection technologies. In particular, the electromagnetic radiation sensor 45 in the present invention detects electromagnetic radiation emitted when a beverage begins to freeze. Generally, beverages include mostly water and it is thus possible to determine the time when a beverage begins to freeze by detecting electromagnetic radiation emitted or a change in electromagnetic radiation emitted when water in the beverage begins to freeze through the electromagnetic radiation sensor 45.

It is known that water emits electromagnetic radiation in a specific frequency band when the water begins to freeze to form an ice nucleus or when an ice nucleus grows. This fact is described in an article "PRORODA(NATURE), No. 9, 2000, Shibkov A. A., Zheltov M. A. and Korolev A. A. "Intrinsic Electromagnetic Radiation of Towering Ice"), Http://courier.com.ru/priroda/pr0900cont.htm" published in Russia. This article showed that water emits electromagnetic radiation in a band of 101-102 Hz when an ice nucleus begins to form in the water and electromagnetic radiation in a band of 103-106 Hz when an ice nucleus grows to begin to crystallize.

When a beverage emits electromagnetic radiation in a band of 101-102 Hz or electromagnetic radiation in a band of 103-106 Hz, the electromagnetic radiation sensor 45 detects the electromagnetic radiation and transmits the detection signal to the controller 51 and then the controller 51 immediately activates an electric heater 46 corresponding to the beverage to prevent freezing of the beverage.

According to the embodiment of the present invention, a database regarding specific frequencies of electromagnetic radiation emitted when ice nuclei form in various commercial beverages or specific frequencies of electromagnetic radiation emitted when ice nuclei grow in various commercial beverages may be produced and stored in a memory 54. This makes it possible to determine a more accurate time when a given beverage begins to freeze.

The controller 51 controls the overall operation of the refrigerator and is connected to the cooling unit 20, the blower fans 33 and 37, the temperature sensor 52, a plurality of signal amplifiers 47, an input unit 53, the memory 54, and an RFID reader 55 as shown in FIG. 3. Here, the signal amplifiers 47 amplify detection signals that are transmitted from the electromagnetic radiation sensors 45 to the controller 51.

The input unit 53 and the RFID reader 55 provide information regarding beverages contained in the supercooling compartment 13 to the controller 51 so that the temperature of the supercooling compartment 13 is adjusted to suit the characteristics of the beverages and that thermal energy is applied to the beverages at appropriate times. The information regarding the beverages (for example, a range of supercool temperatures, appropriate supercool temperatures, supercool temperature limits, a band of frequencies of electromagnetic radiation emitted when an ice nucleus forms, and a band of frequencies of electromagnetic radiation emitted when an ice nucleus grows) is stored in the memory 54. The controller 51 controls the temperature of the supercooling compartment 13 based on the information stored in the memory 54 so that a selected beverage is maintained at an appropriate or maximum supercooled level and activates the electric heater 46 when the beverage begins to freeze.

The input unit 53 allows a user to input information required for control such as the types of beverages contained in the supercooling compartment 13, reference supercool temperatures set according to beverages, and a band of frequencies of electromagnetic radiation in which the electric heater 46 is to be activated. The RFID reader 55 detects RFID tags (not shown) attached to containers of beverages contained in the supercooling compartment 13 and transmits the detection information of the beverages to the controller 51. As known in the art, an RFID tag attached to a container of a beverage stores identification (ID) of the beverage. The controller 51 determines the type of a beverage to be stored through a signal received from the RFID reader 55 and controls the operation of the refrigerator based on the information regarding the beverage stored in the memory 54.

Figure 5:
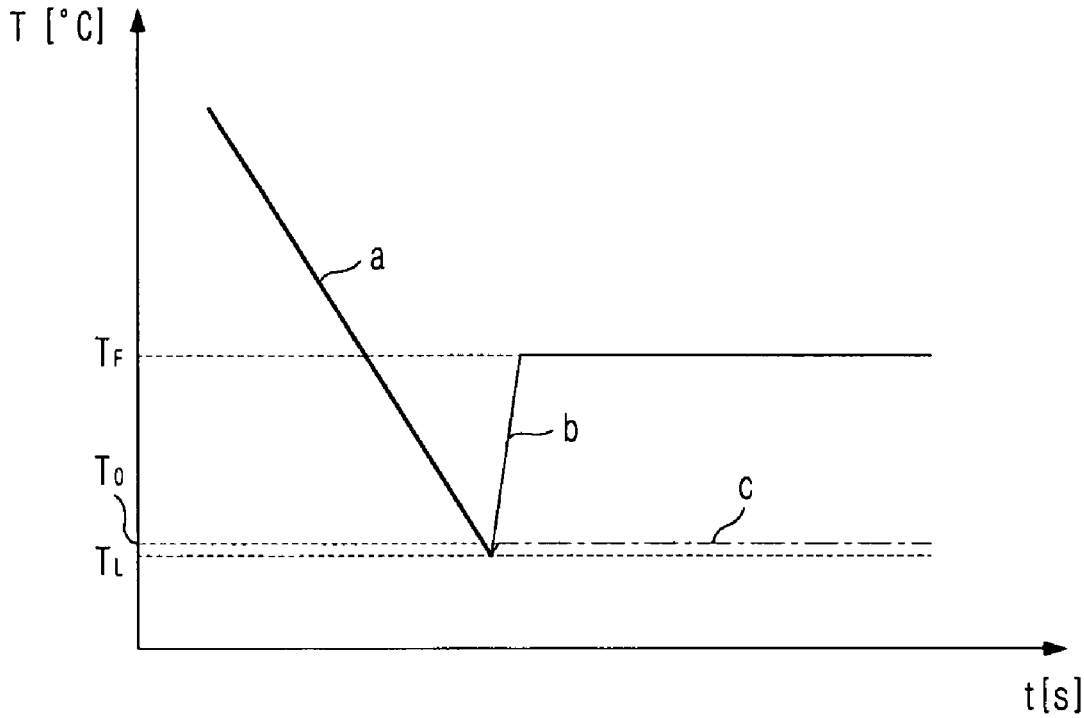
FIG. 5 is a graph showing temperature change of water in a supercooling compartment.

In the refrigerator according to the embodiment of the present invention constructed as described above, when beverages are contained in the receptacles 42 of the supercooling compartment 13, the controller 51 controls the temperature of the supercooling compartment 13 so that each beverage is maintained at an appropriate or maximum supercooled level to suit the characteristics of the beverage. The electromagnetic radiation sensor 45 detects electromagnetic radiation emitted from each beverage in the supercooling compartment 13 while the beverage is cooled at a temperature, less than or equal to a freezing temperature TF, along a temperature line 'a' as shown in FIG. 5.

The temperature of the supercooling compartment 13 may vary while the controller 51 maintains the temperature of the supercooling compartment 13 at a temperature less than or equal to the freezing temperature TF of each beverage. If the temperature of the supercooling compartment 13 varies to reach a supercool temperature limit TL of each beverage, an ice nucleus may form in the beverage while the temperature of the beverage rapidly changes along a temperature line 'b' so that the beverage freezes at the freezing temperature TF. When the temperature of the beverage reaches the supercool temperature limit TL so that the beverage begins to freeze, the beverage emits electromagnetic radiation in a specific frequency band (for example, a band of 101-102 Hz) as an ice nucleus begins to form in the beverage or electromagnetic radiation in a band of 103-106 Hz as an ice nucleus grows. The corresponding electromagnetic radiation sensor 45 detects electromagnetic radiation in the specific frequency band emitted from the beverage and generates a detection signal. The detection signal is transmitted to the controller 51 after being amplified by the signal amplifier 47. The controller 51 then activates the electric heater 46 corresponding to the beverage to prevent freezing of the beverage.

While the electric heater 46 applies thermal energy to the beverage, the corresponding electromagnetic radiation sensor 45 constantly detects electromagnetic radiation emitted from the beverage. If the frequency of the emitted electromagnetic radiation is changed while ice nuclei in the beverage are removed, the electromagnetic radiation sensor 45 detects this change and transmits the detection signal to the controller 51 and the controller 51 then deactivates the electric heater 46 according to the detection signal. This operation of the electric heater 46 allows the temperature of the beverage to be maintained at an appropriate supercool temperature TO as shown by a temperature line C without being reduced to the supercool temperature limit TL. The activation of the electric heater 46 can be controlled based on time. In this case, after activating the electric heater 46 for a specific time, the controller 51 deactivates the electric heater 46 to prevent freezing of the beverage.

Even if no information regarding beverages contained in the supercooling compartment 13 is stored in the memory 54, by detecting electromagnetic radiation emitted from each beverage through the electromagnetic radiation sensor 45, the controller 51 can determine the time when the beverage begins to freeze and activate the electric heater 46 to prevent freezing of the beverage at the time. The controller 51 can update the beverage information in the memory 54 by storing new beverage information in the memory 54 using a detection signal received from the temperature sensor 52 or a detection signal received from the electromagnetic radiation sensor 45.

Figure 6:
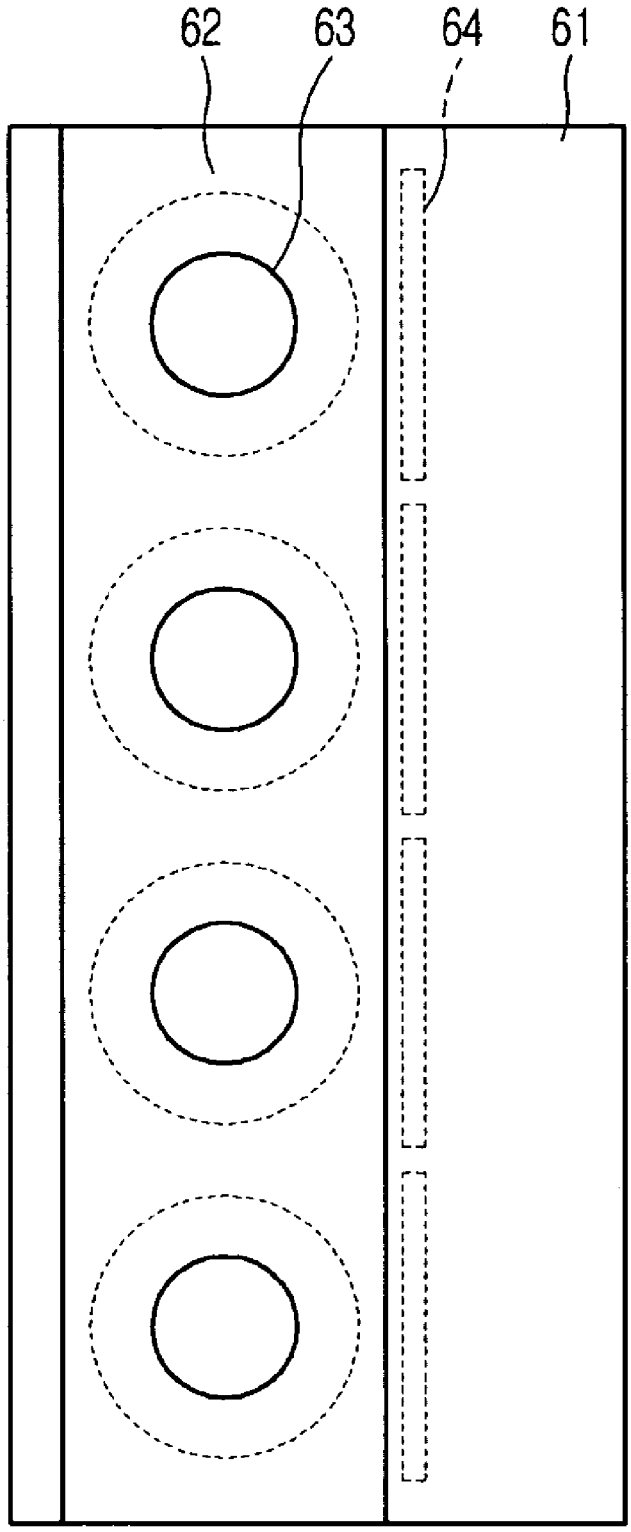
FIGS. 6 and 7 are a plan view and a front cross-sectional view showing another embodiment of the receptacle provided in the refrigerator according to the embodiment of the present invention.
Figure 7:
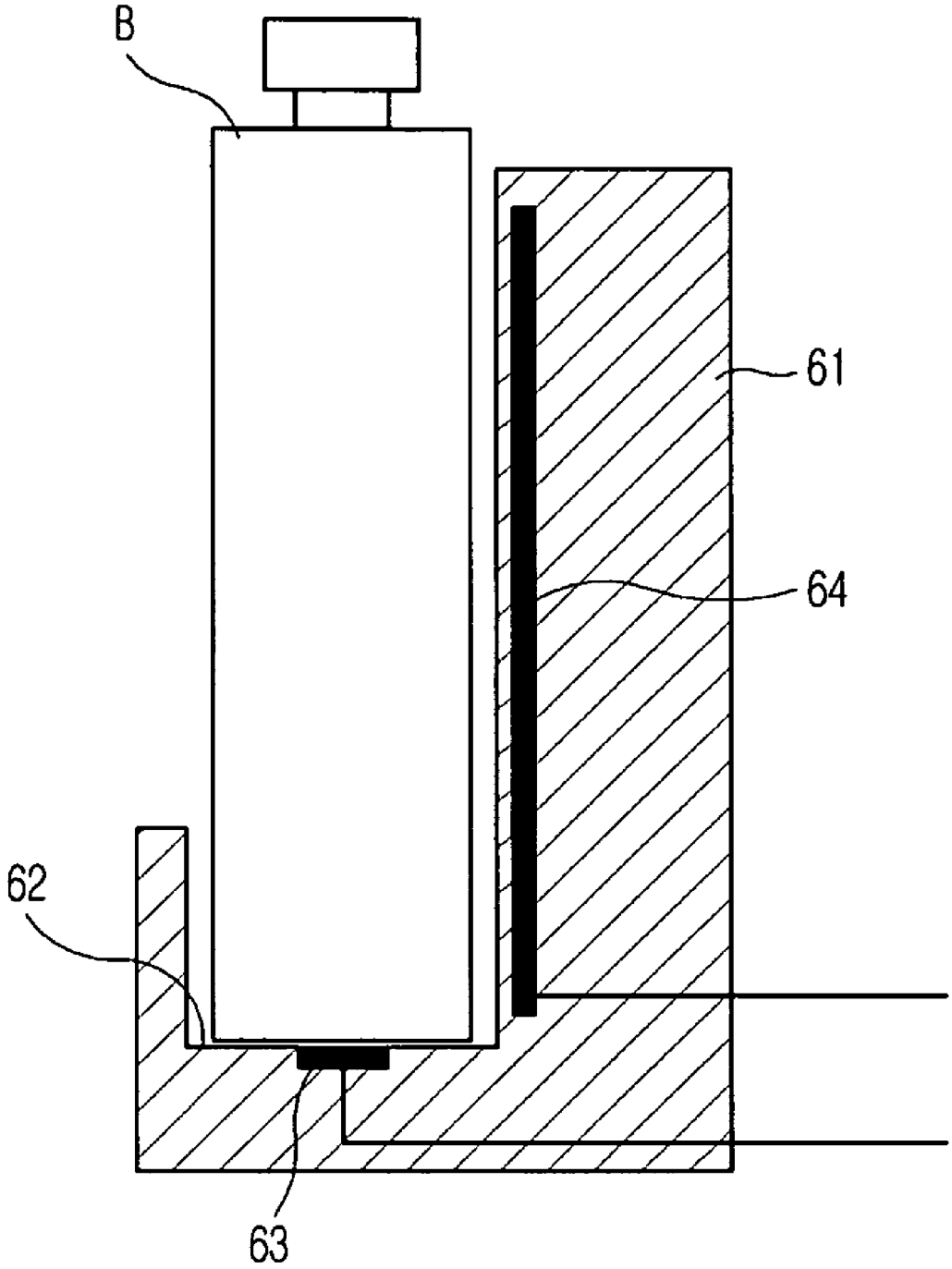

FIGS. 6 and 7 show a different type of receptacle 61 that can be installed in the supercooling compartment 13 of the refrigerator according to the embodiment of the present invention.

The receptacle 61 shown in FIGS. 6 and 7 has no individual receiving rooms to allow beverages to be smoothly received and removed and a plurality of receiving portions 62 where beverages can be placed are provided at one portion of the receptacle 61. An electromagnetic radiation sensor 63 is provided in each receiving portion 62 to detect electromagnetic radiation emitted from a beverage placed on the receiving portion 62. An electric heater 64 is also provided at one side of each receiving portion 62 to apply thermal energy to a beverage placed on the receiving portion 62 to prevent freezing of the beverage in a supercooled state.

Here, we omit a description of detailed operations of each electromagnetic radiation sensor 63 and each electric heater 64 since they are similar to those of the embodiment shown in FIGS. 3 and 4.

The refrigerator according to the embodiment of the present invention may also be provided with a dedicated non-metal container B to contain each beverage to form slush. In the case of beverages contained in metal containers among commercial beverages, electromagnetic radiation emitted from each beverage when it begins to freeze may be shielded by the metal containers. If the beverage is supercooled after being transferred into a dedicated non-metal container B, the electromagnetic radiation sensor 45 can effectively detect electromagnetic radiation emitted from the beverage.

The embodiment of the present invention can be applied not only to maintain a beverage in a supercooled state to form slush but also to maintain the freshness of food other than a beverage using an electromagnetic radiation sensor and an energy supply. For example, it is possible to keep food stored in a refrigerator fresh without freezing the food by producing and storing a database regarding electromagnetic radiation emitted when food stored in a refrigerator begins to freeze in the memory 54 and detecting electromagnetic radiation emitted from the stored food and then applying energy to the food according to the detection.

As is apparent from the above description, the embodiment of the present invention provides a refrigerator and a method to control the same with a variety of features and advantages. For example, electromagnetic radiation emitted from each beverage in a supercooled state when the beverage begins to freeze is detected and energy is applied to the beverage according to the detection, thereby stably keeping the beverage in a supercooled state.

In addition, a change in the state of each beverage stored in the supercooling compartment is individually detected to individually prevent freezing of each beverage. Thus, it is not necessary to accurately control the temperature of the supercooling compartment according to the characteristics of beverages stored in the supercooling compartment and therefore temperature control of the refrigerator is not complex.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body defining a supercooling compartment;

a cooling unit to provide cool air to the supercooling compartment;

an electromagnetic radiation sensor to detect electromagnetic radiation emitted when a food placed in the supercooling compartment begins to freeze;

an energy supply to apply energy to the food placed in the supercooling compartment to prevent freezing of the food; and a controller to receive a detection signal from the electromagnetic radiation sensor and then to activate the energy supply, wherein the controller activates the energy supply when the electromagnetic radiation sensor detects electromagnetic radiation emitted when an ice nucleus forms in the food.

2. The refrigerator according to claim 1, further comprising a receiving portion to receive the food, the receiving portion being provided in the supercooling compartment and the electromagnetic radiation sensor being provided adjacent the receiving portion.

3. The refrigerator according to claim 2, further comprising a plurality of the receiving portions and a plurality of the electromagnetic radiation sensors corresponding respectively to the plurality of receiving portions.

4. The refrigerator according to claim 1, further comprising a receiving portion to receive the food, the receiving portion being provided in the supercooling compartment, and wherein the energy supply is provided near the receiving portion.

5. The refrigerator according to claim 4, further comprising a plurality of the receiving portions and a plurality of the energy supplies corresponding respectively to the plurality of receiving portions.

6. The refrigerator according to claim 1, further comprising a signal amplifier to amplify a detection signal generated by the electromagnetic radiation sensor.

7. The refrigerator according to claim 1, wherein the energy supply is an electric heater capable of heating the food.

8. A refrigerator comprising:

a body defining a supercooling compartment;

a cooling unit to provide cool air to the supercooling compartment;

an electromagnetic radiation sensor to detect electromagnetic radiation emitted when a food placed in the supercooling compartment begins to freeze;

an energy supply to apply energy to the food placed in the supercooling compartment to prevent freezing of the food; and a controller to receive a detection signal from the electromagnetic radiation sensor and then to activate the energy supply, wherein the controller activates the energy supply when the electromagnetic radiation sensor detects electromagnetic radiation emitted when an ice nucleus grows in the food.

9. A method to control a refrigerator, the method comprising:

reducing a temperature of a supercooling compartment in which food is placed below a freezing temperature;

detecting electromagnetic radiation emitted when the food placed in the supercooling compartment begins to freeze; and applying energy to the food to prevent freezing of the food when the food emits electromagnetic radiation.

10. The method according to claim 9, further comprising:

placing a plurality of foods in the supercooling compartment;

individually detecting respective electromagnetic radiation of each of the foods; and applying energy individually applied to each of the foods.

11. The method according to claim 9, wherein the applying the energy food is in response to the detecting of the electromagnetic radiation emitted when an ice nucleus forms in the food.

12. The method according to claim 9, wherein the applying the energy food is in response to the detecting of the electromagnetic radiation emitted when an ice nucleus grows in the food.

13. The method according to claim 9, further comprising detecting a change in electromagnetic radiation when an ice nucleus is removed from the food while the energy is applied to the food and stopping the application of the energy to the food.

14. The method according to claim 9, wherein the applying the energy to the food includes applying the energy to the food for a specific time.

15. The method according to claim 9, wherein the applying the energy to the food comprises applying thermal energy.

16. The method according to claim 9, further comprising storing information regarding the electromagnetic radiation emitted when the food begins to freeze in a memory.

* * * * *